US008769856B2

(12) United States Patent
Berntsen et al.

(10) Patent No.: US 8,769,856 B2
(45) Date of Patent: Jul. 8, 2014

(54) VOLTAGE-FREE CONNECTOR INTEGRATED IN A WEAPON RAIL

(75) Inventors: Magnus Berntsen, Kista (SE); Rahul Ghose, Harryda (SE); Steven Menzies, Oslo (NO); Michael M. Nihei, Sandefjord (NO); David Christian Petersen, Asgardstrand (NO)

(73) Assignee: Techni AS, Borre (NO)

( * ) Notice: Subject to any disclaimer, the term of this patent is extended or adjusted under 35 U.S.C. 154(b) by 89 days.

(21) Appl. No.: 13/257,478

(22) PCT Filed: Mar. 19, 2010

(86) PCT No.: PCT/NO2010/000108

§ 371 (c)(1), (2), (4) Date: Apr. 4, 2012

(87) PCT Pub. No.: WO2010/107324

PCT Pub. Date: Sep. 23, 2010

(65) Prior Publication Data

US 2012/0180364 A1 Jul. 19, 2012

(30) Foreign Application Priority Data

Mar. 19, 2009 (NO) ..... 20091166

(51) Int. Cl.
*F41A 99/00* (2006.01)

(52) U.S. Cl.
USPC ..... 42/84

(58) Field of Classification Search
USPC ..... 42/84, 90, 114, 115, 124–128, 142, 42/146, 72, 117; 362/110, 113, 114; 33/266; 356/18
See application file for complete search history.

(56) References Cited

U.S. PATENT DOCUMENTS

| | | | | |
|---|---|---|---|---|
| 7,029,328 | B1 * | 4/2006 | Mckenzie et al. | 439/587 |
| 7,627,975 | B1 * | 12/2009 | Hines | 42/84 |
| 7,975,419 | B2 * | 7/2011 | Darian | 42/84 |
| 8,151,505 | B2 * | 4/2012 | Thompson | 42/84 |
| 2002/0129536 | A1 * | 9/2002 | Iafrate et al. | 42/134 |

(Continued)

FOREIGN PATENT DOCUMENTS

| | | |
|---|---|---|
| WO | 2008/108818 A2 | 9/2008 |
| WO | 2010/004470 A1 | 1/2010 |

OTHER PUBLICATIONS

International Search Report from PCT/NO2010/000108 dated Jul. 19, 2010 (2 pages).

(Continued)

*Primary Examiner* — John D Cooper
(74) *Attorney, Agent, or Firm* — Osha Liang LLP

(57) ABSTRACT

A universal rail for a firearm has a plurality of through holes and a plurality of attachment points for ancillary equipment along a length of the universal rail, a fastener so as to be fastenable to the firearm, and a power or signal connection point arranged in at least one attachment point of the plurality of attachment points. The power or signal connection point has at least two contact pins surrounded by a seal, and a resilient portion and inner contact faces. The power or signal connection point is further connected to conductors arranged in the universal rail. The resilient portion ensures that the at least two contact pins and contact points are out of contact with each other when the ancillary equipment is not mounted on the universal rail.

22 Claims, 2 Drawing Sheets

(56) References Cited

U.S. PATENT DOCUMENTS

| | | | | |
|---|---|---|---|---|
| 2004/0219843 | A1* | 11/2004 | Baker et al. | 439/851 |
| 2008/0134562 | A1* | 6/2008 | Teetzel | 42/146 |
| 2009/0044439 | A1 | 2/2009 | Phillips et al. | |

OTHER PUBLICATIONS

International Preliminary Report on Patentability from PCT/NO2010/000108 dated Jun. 14, 2011 (7 pages).

* cited by examiner

VOLTAGE-FREE CONNECTOR INTEGRATED IN A WEAPON RAIL

The present invention relates to a rail device for a firearm, and more specifically, the present invention relates to a rail device to which various ancillary equipment, such as a tactical light, a laser sight, communication units or the like can be attacked, a plurality of connectors in the rail system providing power and/or signals to or between one or more units of ancillary equipment. The signals may be of different kinds whereby they also may conceivably be able to transmit information.

A firearm according to the present invention should be understood to comprise both long weapons such as rifles and shotguns, and handguns such as revolvers and pistols.

Increasing demands are made on today's modern firearms, whether they be civilian or military. Not only from a safety and constructional point of view must they prevent misuse and failure in the most extreme conditions, they must also be capable of being equipped with different ancillary equipment which will increase the firearm's applications, efficiency and (impact) force.

Such ancillary equipment may be mounted on the firearm itself, or be attached to the firearm by means of so-called universal rails. The ancillary equipment may for example consist of an optical telescopic sight, a bayonet, a grenade thrower, various light sources and communication units.

The connection of the various light sources, for example, an ordinary flashlight, an infrared light or a laser, to a firearm has proven extremely useful in many connections. An ordinary flashlight will, for example, allow the firearm to be used in the dark. For this purpose, the flashlight is mounted on the firearm such that the flashlight's light cone will illuminate the target of the firearm. In other cases, it will be desirable that the user of the firearm, for example, a soldier, should not give his position away. If laser is used, this could be arranged to coincide with the firearm's point of impact, such that the projectile hits the point on which the laser falls. Similarly, in other cases there will be a need for the firearm to be equipped with infrared light, the user of the firearm, by using night vision glasses, then being able to utilise the firearm in complete darkness.

The existing universal rails are, however, not configured with power and/or signal connection points for ancillary equipment, which means that each individual unit of the ancillary equipment must be equipped with a separate battery pack in order to work. This might increase the weight of the firearm, make it more bulky etc., which is not desirable. Examples of such weapon rails are Picatinny rails or MIL-STD-1913 rails.

Another disadvantage is that the user of the firearm, via control switches, must activate/deactivate the different ancillary equipment, which means that the user must free one hand during this operation. This may be a disadvantage in critical situations and is therefore undesirable.

An object of the present invention is therefore to provide a universal rail for a firearm where the disadvantages of the prior art are eliminated or at least diminished.

Another object according to the present invention will be to provide a universal rail for a firearm, where the universal rail is configured with a plurality of power and/or signal connection points for the ancillary equipment, and where all ancillary equipment is connected via the power and/or signal connection points to a central power and/or signal unit.

A further object according to the present invention will be to provide a universal rail for a firearm, where the power and/or signal connection points will not produce a current (voltage) before the ancillary equipment is connected to the power and/or signal connection point.

Yet another object according to the present invention is to provide a waterproof contact connection to the ancillary equipment so as to prevent leakage current between the contacts.

These objects are obtained by means of a rail device as disclosed in the following independent claim, with additional features set forth in the dependent claims and the description below.

According to the present invention there is provided a universal rail for a firearm, the universal rail being made in one piece or in several components that are assembled to form the universal rail. The universal rail is made of a suitable material, for example, a composite material, a metallic material, several different metallic materials or a combination thereof. The weapon rail may, in one embodiment, be configured as an integral part of the stock of the firearm, or it may be made having a rectangular cross-section, the weapon rail, with the aid of fastening means, thus being capable of being mounted at different points on the firearm.

If the weapon rail is arranged over parts of the barrel of the firearm, the weapon rail is preferably configured with a plurality of through holes along its length and surface, these through holes ensuring a cooling of the firearm during use. The weapon rail may, however, also be configured without any such through holes.

The universal rail, on its upper face, which will preferably be plane, and along its length, is further configured with a plurality of attachment points for different ancillary equipment which may be connected to the universal rail, where the ancillary equipment may consist of a tactical light, a laser sight, communication units etc. The attachment points consist preferably of a plurality of transverse ribs which extend across the whole or parts of the upper face of the weapon rail. The ancillary equipment's connection points will then be complementarily shaped. The ancillary equipment may then be pushed sideways into the weapon rail's connection points.

Alternatively, the connection points may be so configured that the ancillary equipment is "snapped", "clicked", "locked" or also screwed into or onto the weapon rail's connection points.

At least in one of the universal rail's attachment points there is further arranged a power and/or signal connection point for the said ancillary equipment, the power and/or signal connection point comprising one or more contact pins which are partly surrounded by a seal, one or more resilient means and one or more contact faces. The power and/or signal connection point is further connected to at least one conductor which extends along the whole or parts of the length of the universal rail.

The seal which partly surrounds the contact pins in the power and/or signal connection points may, for example, consist of an elastomeric material or a membrane, while the resilient means expediently consists of a spring or a membrane. The contact pins consist of a body and possibly a "head", where at least the body of the contact pin is surrounded by the elastomeric material or the membrane. The contact pins and the elastomeric material or membrane are so arranged that the contact pins are allowed to move relative to the seal, or they may be integrated in the seal such that the contact pins and seal move together as a unit.

The contact pins in the power and/or signal connection point may have any suitable shape, but are preferably configured with a circular cross-section. The power and/or signal connection points will also be configured in such a way that there will be no contact between the contact pins and the contact faces when ancillary equipment is not mounted in the attachment point in question.

As it is expedient that the contact between the contact pins and contact faces is as great as possible, the contact pins are made in the form of a "T". However, it should be understood that the contact pins may be configured so as to have other shapes.

In that the power and/or signal connection points comprise a resilient means, either in the form of a spring, an elastic material or the like, the resilient means will ensure that contact pins and contact faces are out of engagement with each other when the ancillary equipment is not connected to the power and/or signal connection points.

The seal in the power and/or signal connection point that surrounds the contact pins will also be configured so as to form a dustproof and waterproof connection between the ancillary equipment and the power and/or signal connection point.

Other advantages and special features of the present invention will be set forth clearly in the following detailed description, the attached figures and the following claims.

The invention will now be described in more detail with reference to the following figures, wherein.

Figure 1:
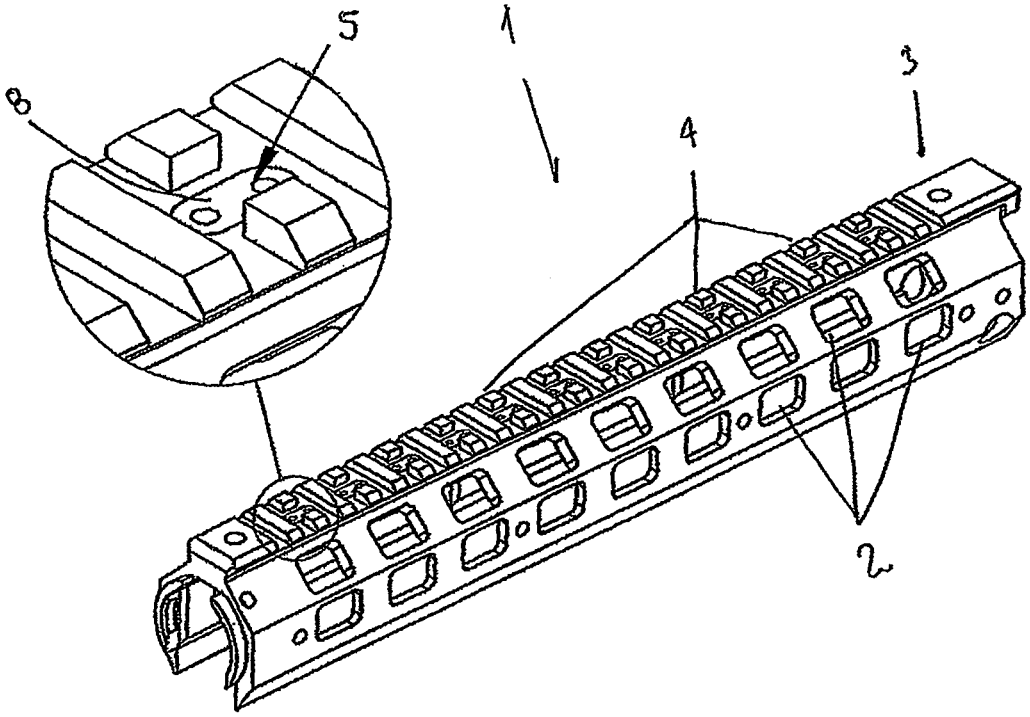
FIG. 1 shows a first embodiment of a rail device according to the present invention.

FIG. 1 shows a universal rail 1 according to the present invention, where the universal rail 1 is configured to be connected by means of fastening devices (not shown) to a firearm (not shown). As the universal rail 1 is to be connected to the barrel of the firearm, the rail 1, along its length, is configured with a plurality of through holes 2. The through holes 2 serve as "vent and cooling holes", the barrel of the firearm possibly becoming hot during use, whereby this heat is allowed to be led away from the firearm's barrel.

The universal rail 1, on its flat upper side 3, is further configured with a plurality of attachment points 4 for different ancillary equipment (not shown). The attachment points 4 will then cooperate with a corresponding attachment point or points on the ancillary equipment, where the attachment points 4 may be of such a type that the ancillary equipment (not shown) either can be pushed sideways into the attachment points 4, or can be "snapped" or "clicked" into the attachment points 4.

The attachment points 4 consist of a plurality of transverse ribs. The transverse ribs are alternately arranged as continuous and non-continuous ribs. A connection point 4 will consist of two continuous adjacent transverse ribs and an intermediate non-continuous transverse rib.

Furthermore, disposed between each attachment point 4, in the gap in the non-continuous transverse rib, are power and/or signal connection points 5 for the ancillary equipment, which power and/or signal connection points 5 will provide a contact between a power and/or control unit (not shown) that is connected to the universal rail 1. The power and/or control unit (not shown) may either be integrated into the universal rail 1 itself, or it may be a separate, removable unit which, in a similar way to the ancillary equipment, can be connected to the universal rail 1. The power and/or control unit may also be connected to the rail's conductors directly and not via the attachment points 4.

One or more conductors (not shown) are integrated in the universal rail 1, these conductors being further connected to each power and/or signal connection point 5 in the universal rail 1. This means that all power and/or signal connection points 5 are connected to each other via conductors in, for instance, two groups connected to, for example, positive and negative polarity, whereby a single power and/or control unit will be able to provide necessary power to "drive" all ancillary equipment which is connected to the universal rail 1 at the same time. A control unit connected to the universal rail 1 will similarly also be able to provide the connected units with control signals.

Figure 2:
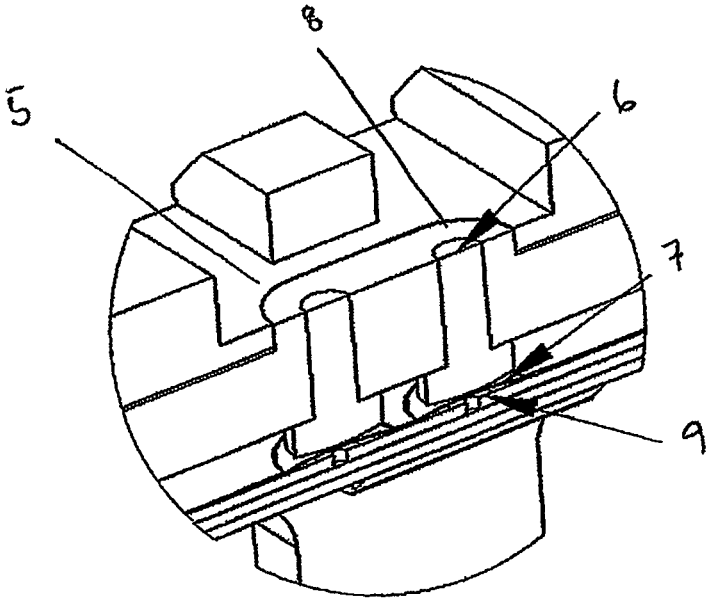
FIG. 2 shows details of the power and/or signal connection points according to the present invention.

FIG. 2 shows details of the power and/or signal connection points 5, where it is seen that the power and/or signal connection point 5 comprises two outer contact pins 6 that extend though the body of the universal rail 1 and down into contact with a resilient means 7. The outer contact pins 6 in the power and/or signal connection point 5 are further arranged in a seal, for example, a flexible elastomer 8, this elastomer 8 protecting the contact pins 6 and at the same time preventing dust, sand, clay, moisture or water from entering into the universal rail 1. The purpose of the upper side of the elastomer 8 is to act as a sealing face against the corresponding function in the ancillary equipment.

The resilient means 7, which may be a flexible elastomer or simply a (dish) spring will, when ancillary equipment is not connected to the power and/or signal connection point 5, seek to push the contact pins 6 out of engagement with inner contact faces 9, the inner contact faces 9 being connected to conductors (not shown) which extend in the longitudinal direction of the universal rail 1.

In the case where ancillary equipment is not connected to a power and/or signal connection point 5, the spring device 7 will push the contact pins 6 out of engagement with the inner contact faces 9, whereby this power and/or signal connection point 5 will not be connected to power and/or signal. When ancillary equipment is connected to a power and/or signal connection point 5, contact pins in the ancillary equipment's connection point will push the contact pins inwards in the universal rail 1, whereby the resistance of the resilient means 7 is overcome and the contact pins 6 are brought into engagement with the inner contact faces 9. If a power-supplying unit is connected to the universal rail 1 and is activated, power will be provided to the connected ancillary equipment.

The contact pins 6 are made in the form of a "T" and are arranged as an inverted "T" in the seal 8, as shown in FIG. 2. The travel of the contact pins 6 into the weapon rail 1 will be limited by the underside of the seal 8 and the resilient means 7.

Figure 3:
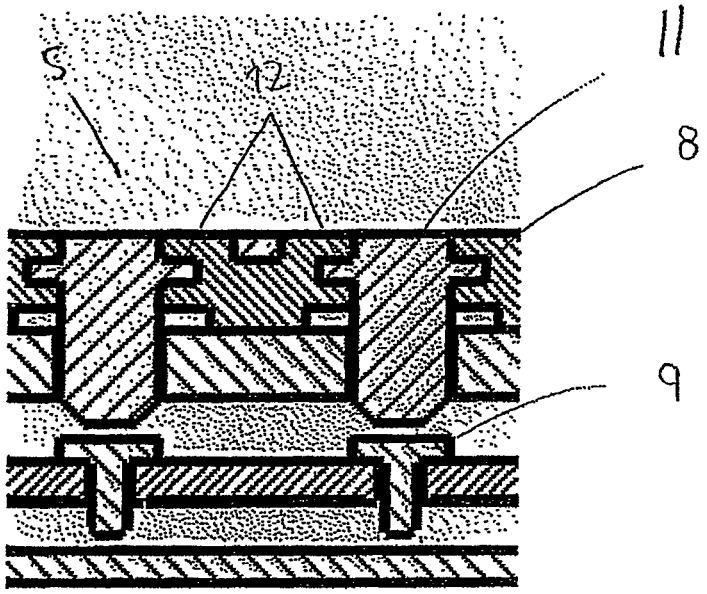
FIG. 3 shows a cross-section of an alternative embodiment of the power and/or signal connection points according to the present invention.

FIG. 3 shows a section of an alternative embodiment of the power and/or signal connection points according to the present invention.

In this embodiment the contact pins 11 of the power and/or signal connection point 5 are embedded in an elastomer 8. The contact pins 11 are configured with one or more flanges 12, which flanges 12 are to ensure a secure fixing of the contact pins 11 in the elastomer 8. Owing to the properties of the elastomer 8, it will not be necessary in this embodiment to arrange a resilient means between the contact pins 11 and the inner contact faces 9, as the elastomer 8 and the embedded contact pins 11 will be forced out of their starting position when ancillary equipment is connected to the power and/or signal connection point 5. The contact pins 11 will then be brought into engagement with inner contact faces 9, thereby enabling power and/or signal to be provided to the ancillary equipment. Similarly, the elastomer 8 and the contact pins 11, because of the properties of the elastomer 8, will assume their original starting position when the ancillary equipment is disconnected from the attachment point.

In the above, only elements that relate to the invention have been explained and described, and a person of skill in the art will understand that the weapon rail may be configured in one piece or it may be comprised of several elements that are inter-connected. The skilled person will further understand that within the scope of the invention as defined in the attached claims it is possible to provide several versions and modifications of the described and illustrated embodiments.

The invention claimed is:

1. A universal rail for a firearm comprising:

a plurality of through holes and a plurality of attachment points for ancillary equipment along a length of the universal rail;

fastener so as to be fastenable to the firearm; and a power or signal connection point arranged in at least one attachment point of the plurality of attachment points, wherein the power or signal connection point comprises:

at least two contact pins surrounded by a seal, and a resilient element comprising a separate spring and inner contact faces, wherein the power or signal connection point is further connected to conductors arranged in the universal rail, and wherein the resilient element ensures that the at least two contact pins and contact points are out of contact with each other when the ancillary equipment is not mounted on the universal rail.

2. A device according to claim 1, wherein the contact pins have the shape of a T.

3. A device according to claim 1, wherein the contact pins are configured with a circular cross-section.

4. A device according to claim 1, wherein the contact pins are configured with a non-circular cross-section.

5. A device according to claim 1, wherein the inner contact faces are fixedly connected to conductors which extend in the longitudinal direction of the universal rail.

6. A device according to claim 1, wherein a power or signal connection point is arranged to each attachment point.

7. A device according to claim 1, wherein the universal rail is made of a composite material.

8. A device according to claim 1, wherein the universal rail is made of a metallic material or a combination of metallic materials.

9. A device according to claim 1, wherein a bar of the universal rail is made in several parts that are mounted together.

10. A device according to claim 1, wherein a bar of the universal rail is made in one piece.

11. A device according to claim 1, wherein the contact points are surrounded by a seal with a defined sealing face against the ancillary equipment.

12. A device according to claim 11, wherein the seal comprises a membrane or an elastomer.

13. A device according to claim 1, wherein the seal in engagement with ancillary equipment forms a waterproof chamber around the contact pin and opposing pin in the ancillary equipment.

14. A device according to claim 1, wherein the power or signal connection points are arranged in the rail so that engagement between the contact pin and the contact point takes place in a waterproof chamber.

15. A device according to claim 1, wherein the contact pins are surrounded by an elastomer such that the connection is waterproof.

16. A device according to claim 1, wherein the contact pins are resiliently mounted in the elastomer.

17. A device according to claim 1, wherein the inner contact faces are fixedly connected to conductors that extend in the longitudinal direction of the universal rail.

18. A device according to claim 1, wherein the inner contact faces are fixedly connected to conductors that extend in the longitudinal direction of the universal rail and connect one of two power or signal connection points in an attachment point to a corresponding power or signal connection point or points in one or more such attachment points along the rail.

19. A device according to claim 1, wherein the contact points are surrounded by a membrane having a defined sealing face against the ancillary equipment.

20. A device according to claim 1, wherein the contact pins have the shape of a T, wherein the contact points are surrounded by a seal with a defined sealing face against the ancillary equipment, and wherein the inner contact faces are fixedly connected to conductors that extend in the longitudinal direction of the universal rail and connect one of two power or signal connection points in an attachment point to a corresponding power or signal connection point or points in one or more such attachment points along the rail.

21. A universal rail for a firearm comprising:

a plurality of through holes and a plurality of attachment points for ancillary equipment along a length of the universal rail; fastener so as to be fastenable to the firearm;

a power or signal connection point arranged in at least one attachment point of the plurality of attachment points, wherein the power or signal connection point comprises:

at least two contact pins surrounded by a seal, and a resilient element and inner contact faces, wherein the power or signal connection point is further connected to conductors arranged in the universal rail, wherein the resilient element ensures that the at least two contact pins and contact points are out of contact with each other when the ancillary equipment is not mounted on the universal rail, and wherein the resilient element comprises a membrane that is flexible.

22. A universal rail for a firearm comprising:

a plurality of through holes and a plurality of attachment points for ancillary equipment along a length of the universal rail; fastener so as to be fastenable to the firearm;

a power or signal connection point arranged in at least one attachment point of the plurality of attachment points, wherein the power or signal connection point comprises:

at least two contact pins surrounded by a seal, and a resilient element and inner contact faces, wherein the power or signal connection point is further connected to conductors arranged in the universal rail, wherein the resilient element ensures that the at least two contact pins and contact points are out of contact with each other when the ancillary equipment is not mounted on the universal rail, and wherein the contact pins are connected to an elastomer such that the connection is waterproof.

* * * * *